US009711123B2

(12) United States Patent
Ogasawara

(10) Patent No.: US 9,711,123 B2
(45) Date of Patent: Jul. 18, 2017

(54) VOICE SYNTHESIS DEVICE, VOICE SYNTHESIS METHOD, AND RECORDING MEDIUM HAVING A VOICE SYNTHESIS PROGRAM RECORDED THEREON

(71) Applicant: YAMAHA CORPORATION, Hamamatsu-shi, Shizuoka-Ken (JP)

(72) Inventor: Motoki Ogasawara, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/934,627

(22) Filed: Nov. 6, 2015

(65) Prior Publication Data

US 2016/0133246 A1 May 12, 2016

(30) Foreign Application Priority Data

Nov. 10, 2014 (JP) ..... 2014-227773

(51) Int. Cl.

| | |
|---|---|
| ***G10H 7/02*** | (2006.01) |
| ***G10H 5/02*** | (2006.01) |
| ***G10L 13/06*** | (2013.01) |
| ***G10H 1/00*** | (2006.01) |
| ***G10L 13/033*** | (2013.01) |

(52) U.S. Cl.

CPC ..... *G10H 5/02* (2013.01); *G10H 1/0066* (2013.01); *G10H 7/02* (2013.01); *G10L 13/033* (2013.01); *G10L 13/06* (2013.01); *G10H 2250/455* (2013.01)

(58) Field of Classification Search

CPC ..... G10L 13/033; G10L 13/06; G10H 7/02; G10H 2250/455; G10H 1/0066; G10H 5/02

See application file for complete search history.

(56) References Cited

U.S. PATENT DOCUMENTS 4,716,591 A * 12/1987 Masuzawa ..... G10L 13/08 704/268
5,796,916 A * 8/1998 Meredith ..... G10L 13/10 704/207
5,915,237 A * 6/1999 Boss ..... G10H 1/0066 704/238
6,006,187 A * 12/1999 Tanenblatt ..... G10L 13/033 704/255
6,029,131 A * 2/2000 Bruckert ..... G10L 13/08 704/260
6,363,342 B2 * 3/2002 Shaw ..... 704/220

(Continued)

FOREIGN PATENT DOCUMENTS

JP 2002221978 A 8/2002

*Primary Examiner* — Fariba Sirjani

(74) *Attorney, Agent, or Firm* — Rossi, Kimms & McDowell LLP

(57) ABSTRACT

Provided is a voice synthesis device, including: a voice synthesis information acquisition unit configured to acquire voice synthesis information for specifying a sound generating character; a replacement unit configured to replace at least a part of sound generating characters specified by the voice synthesis information with an alternative sound generating character different from the sound generating character; and a voice synthesis unit configured to execute a second synthesis process for generating a voice signal of an utterance sound obtained by the replacing.

10 Claims, 5 Drawing Sheets

(56) References Cited

U.S. PATENT DOCUMENTS

| | | | | |
|---|---|---|---|---|
| 6,462,264 | B1 * | 10/2002 | Elam | G10H 1/0066 341/60 |
| 6,581,034 | B1 * | 6/2003 | Choi | G06F 17/273 704/10 |
| 6,865,533 | B2 * | 3/2005 | Addison | G09B 5/04 704/260 |
| 6,970,819 | B1 * | 11/2005 | Tabei | G10L 13/10 704/205 |
| 2002/0013707 | A1 * | 1/2002 | Shaw | G10L 15/063 704/257 |
| 2002/0138248 | A1 * | 9/2002 | Corston-Oliver | G06F 17/271 704/1 |
| 2004/0177745 | A1 * | 9/2004 | Kayama | G10H 1/0008 84/609 |
| 2006/0015344 | A1 * | 1/2006 | Kemmochi | G10L 13/033 704/267 |
| 2006/0085198 | A1 * | 4/2006 | Kayama | G10L 13/06 704/267 |
| 2007/0260461 | A1 * | 11/2007 | Marple | G09B 5/04 704/260 |
| 2008/0167875 | A1 * | 7/2008 | Bakis | G10L 13/08 704/258 |
| 2009/0144053 | A1 * | 6/2009 | Tamura | G10L 13/06 704/207 |
| 2009/0204395 | A1 * | 8/2009 | Kato | G10L 13/033 704/206 |
| 2010/0312565 | A1 * | 12/2010 | Wang | G10L 13/00 704/260 |
| 2012/0112879 | A1 * | 5/2012 | Ekchian | A61B 5/117 340/5.53 |
| 2012/0143600 | A1 * | 6/2012 | Iriyama | G10L 13/08 704/207 |
| 2014/0195227 | A1 * | 7/2014 | Rudzicz | G10H 1/366 704/231 |

* cited by examiner

| | |
|---|---|
| FIRST CLASS q1 | SEMIVOWEL: /w/, /y/, ··· |
| | NASAL: /m/, /n/, ··· |
| | AFFRICATE: /ts/, ··· |
| | FRICATIVE: /s/, /f/, ··· |
| | CONTRACTED SOUND: /kja/, /kju/, /kjo/, ··· |
| SECOND CLASS q2 | VOWEL: /a/, /i/, /u/, ··· |
| | LIQUID: /r/, /l/, ··· |
| | PLOSIVE: /t/, /k/, /p/, ··· |

Q

VOICE SYNTHESIS DEVICE, VOICE SYNTHESIS METHOD, AND RECORDING MEDIUM HAVING A VOICE SYNTHESIS PROGRAM RECORDED THEREON

CROSS-REFERENCE TO RELATED APPLICATION

The present application claims priority from Japanese Application JP 2014-227773, the content of which is hereby incorporated by reference into this application.

BACKGROUND OF THE INVENTION

1. Field of the Invention

The present invention relates to a technology for synthesizing a voice such as a singing voice.

2. Description of the Related Art

Hitherto, there has been proposed a voice synthesis technology for synthesizing a voice signal of a voice obtained by generating a sound of an arbitrary sound generating character. In a case of synthesizing a voice by generating a sound of a sound generating character in which a vowel succeeds a consonant such as an affricate or a fricative during a target sound generation period, when sound generation of the consonant is started at a start point of the sound generation period, the sound generation of the vowel is started at a time point after a delay of a duration of the consonant from the start point of the sound generation period, which is perceived by a listener as if the sound generation of the sound generating character were started at the time point after the delay from the start point of the target sound generation period. Therefore, there is proposed a technology for generating a voice signal so as to start the sound generation of the consonant before the start point of the target sound generation period and to start the sound generation of the vowel at the start point of the sound generation period (for example, Japanese Patent Application Laid-open No. 2002-221978).

SUMMARY OF THE INVENTION

However, for example, under a situation (real-time voice synthesis) in which the voice signal is synthesized in real time in parallel with an instruction issued from a user to an input device such as a musical instrument digital interface (MIDI) instrument, the sound generation of the consonant is started with the instruction issued from the user as a trigger, and the sound generation of the vowel is started after the sound generation of the consonant is ended. This raises a problem of a large delay amount between a time point at which the instruction is issued by the user and a time point at which the user perceives a voice (vowel) corresponding to the instruction. In view of the above-mentioned circumstances, an object of one or more embodiments of the present invention is to reduce a delay in a synthesized voice.

According to one embodiment of the present invention, there is provided a voice synthesis device, including: a voice synthesis information acquisition unit configured to acquire voice synthesis information for specifying a sound generating character; a replacement unit configured to replace at least a part of sound generating characters specified by the voice synthesis information with an alternative sound generating character different from the part of sound generating characters; and a voice synthesis unit configured to execute a second synthesis process for generating a voice signal of an utterance sound obtained by the replacing.

According to one embodiment of the present invention, there is provided a voice synthesis method, including: acquiring voice synthesis information for specifying a sound generating character; replacing at least a part of sound generating characters specified by the voice synthesis information with an alternative sound generating character different from the part of sound generating characters; and executing a second synthesis process for generating a voice signal of an utterance sound obtained by the replacing.

According to one embodiment of the present invention, there is provided a recording medium having recorded thereon a voice synthesis program for causing a computer to function as: a voice synthesis information acquisition unit configured to acquire voice synthesis information for specifying a sound generating character; a replacement unit configured to replace at least a part of sound generating characters specified by the voice synthesis information with an alternative sound generating character different from the part of sound generating characters; and a voice synthesis unit configured to execute a second synthesis process for generating a voice signal of an utterance sound obtained by the replacing.

DETAILED DESCRIPTION OF THE INVENTION

First Embodiment

Figure 1:
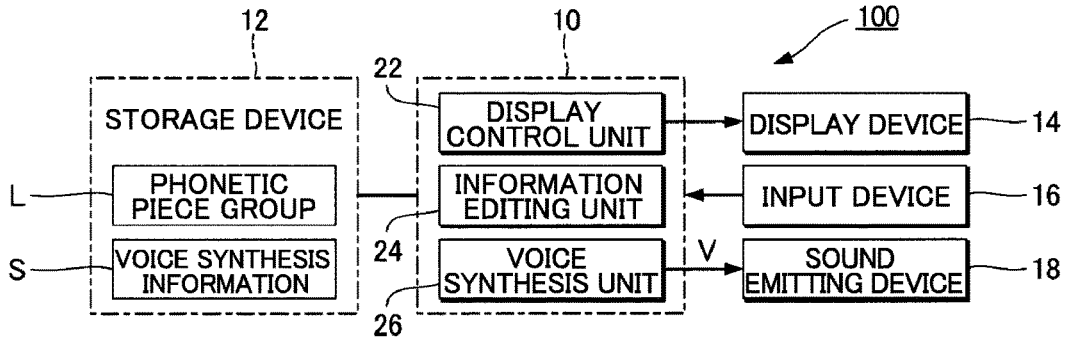
FIG. 1 is a block diagram of a voice synthesis device according to a first embodiment of the present invention.

FIG. 1 is a block diagram of a voice synthesis device 100 according to a first embodiment of the present invention. The voice synthesis device 100 according to the first embodiment is a signal processing device (vocal synthesis device) configured to generate a voice signal V of a synthesized voice, and is realized by a computer system (for example, information processing device such as a mobile phone or a personal computer) including a processor 10, a storage device 12, a display device 14, an input device 16, and a sound emitting device 18. In the first embodiment, a case of generating the voice signal V of a singing voice for a song is assumed.

The display device 14 (for example, liquid crystal display panel) displays an image specified by the processor 10. The input device 16 is an operation device to be operated by a user in order to issue various instructions to the voice synthesis device 100, and includes, for example, a plurality of operating elements to be operated by the user. A touch panel integrated with the display device 14 may also be employed as the input device 16. The sound emitting device 18 (for example, speaker or headphone) emits acoustics corresponding to the voice signal V. Note that, an illustration of a D/A converter configured to convert the voice signal V from a digital signal into an analog signal is omitted for the sake of convenience.

The storage device 12 stores a program to be executed by the processor 10 and various kinds of data to be used by the processor 10. The storage device 12 according to the first embodiment includes a main storage device (for example, primary storage device such as a semiconductor recording medium) and an auxiliary storage device (for example, secondary storage device such as a magnetic recording medium). The main storage device is capable of reading and writing at a higher speed than the auxiliary storage device, while the auxiliary storage device has a larger capacity than the main storage device. As exemplified in FIG. 1, the storage device 12 (typically, auxiliary storage device) according to the first embodiment stores a phonetic piece group L and voice synthesis information S.

The phonetic piece group L is a set (library for voice synthesis) of a plurality of phonetic pieces recorded in advance from voices of a specific utterer. Each phonetic piece is a single phoneme (for example, vowel or consonant) serving as a minimum unit in a linguistic sense, or is a phoneme chain (for example, diphone or triphone) obtained by concatenating a plurality of phonemes. The phonetic piece is stored in the storage device 12 in a form of data indicating a spectrum in a frequency domain or a waveform in a time domain.

Figure 2:
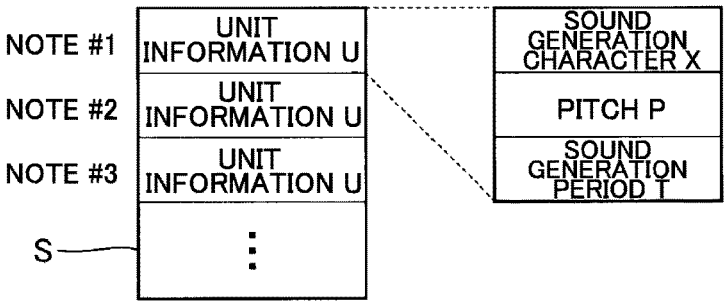
FIG. 2 is a schematic diagram of voice synthesis information.

The voice synthesis information S is time-series data (for example, VSQ file) for specifying a singing voice to be synthesized, and includes, as exemplified in FIG. 2, unit information U for each note for the singing voice. The unit information U on one arbitrary note specifies a sound generating character X, a pitch P, and a sound generation period T of the note. The sound generating character X is a symbol for expressing a detail (namely, lyric) of sound generation of the note for the singing voice. Specifically, for example, a symbol for expressing a mora formed of a single vowel or a combination of a consonant and a vowel is specified as the sound generating character X. The pitch P is, for example, a note number conforming to the musical instrument digital interface (MIDI) standard. The sound generation period T is a period to keep generating a sound of the note for the singing voice, and is specified by, for example, a time point to start the sound generation and a time point to silence the note or a duration of the note.

The processor 10 illustrated in FIG. 1 executes the program stored in the storage device 12, to thereby realize a plurality of functions (display control unit 22, information editing unit 24, and voice synthesis unit 26) for editing the voice synthesis information S and synthesizing the voice signal V. Note that, a configuration in which the respective functions of the processor 10 are distributed to a plurality of devices or a configuration in which an electronic circuit dedicated for voice processing realizes a part of the functions of the processor 10 may be employed.

The display control unit 22 causes the display device 14 to display various images. The display control unit 22 according to the first embodiment causes the display device 14 to display an edit image 40 illustrated in FIG. 3, which allows the user to confirm and edit details of the singing voice specified by the voice synthesis information S. The edit image 40 is an image of a piano roll type in which a graphic form (hereinafter referred to as "note pictogram") 44 for representing each note specified by the voice synthesis information S is arranged in a musical notation area 42 defined by setting a time axis and a pitch axis that are intersecting each other. Specifically, a location of the note pictogram 44 in a pitch axis direction is set depending on the pitch P of the note, and a location and a display length of the note pictogram 44 in a time axis direction are set depending on the sound generation period T of the note. Further, as exemplified in FIG. 3, the sound generating character X for each note is added to the note pictogram 44.

The information editing unit 24 illustrated in FIG. 1 manages the voice synthesis information S. Specifically, the information editing unit 24 generates and edits the voice synthesis information S in response to the instruction issued from the user to the input device 16. For example, the information editing unit 24 adds the unit information U to the voice synthesis information S in response to an instruction to add the note pictogram 44 to the musical notation area 42, and changes the pitch P and the sound generation period T of the unit information U in response to an instruction to move an arbitrary note pictogram 44 and an instruction for expansion or contraction of the arbitrary note pictogram 44 on the time axis. Further, the information editing unit 24 sets the sound generating character X of the unit information U on the note to, for example, an initial-state sound generating character such as "a" when the note pictogram 44 is newly added (when the user has not specified the sound generating character X), and when instructed to change the sound generating character X by the user, changes the sound generating character X of the unit information U.

The voice synthesis unit 26 illustrated in FIG. 1 generates the voice signal V in voice synthesis processing using the phonetic piece group L and the voice synthesis information S that are stored in the storage device 12. The voice synthesis unit 26 according to the first embodiment operates in any one of operation modes including a first operation mode and a second operation mode. For example, in response to the instruction issued from the user to the input device 16, the operation mode of the voice synthesis unit 26 is changed from one of the first operation mode and the second operation mode to the other. The voice synthesis unit 26 executes a first synthesis process in the first operation mode, and executes a second synthesis process in the second operation mode. In other words, the voice synthesis unit 26 according to the first embodiment selectively executes the first synthesis process and the second synthesis process. The first synthesis process is voice synthesis processing (namely, normal voice synthesis processing) for generating the voice signal V of a singing voice obtained by generating a sound of the sound generating character X specified by the voice synthesis information S, and the second synthesis process is voice synthesis processing for generating the voice signal V of a singing voice obtained by replacing the sound generating character X for each note specified by the voice synthesis information S with another sound generating character (hereinafter referred to as "alternative sound generating character"). Note that, a configuration that allows a selection of an operation mode other than the first operation mode or the second operation mode may also be employed.

Figure 3:
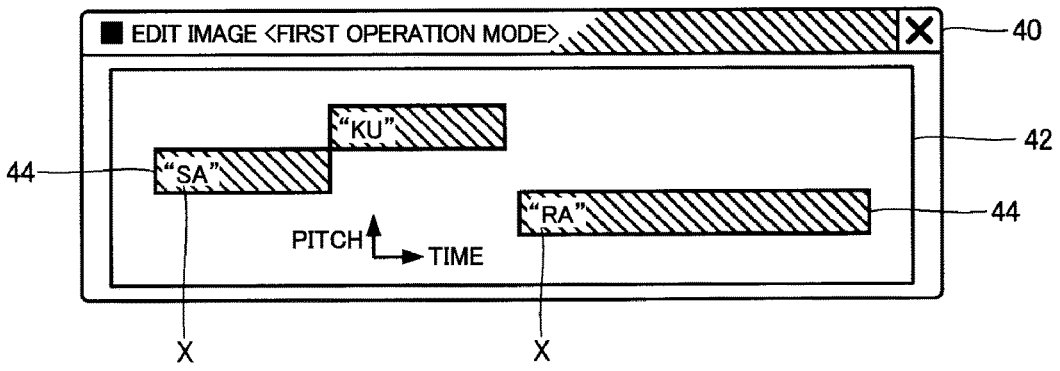
FIG. 3 is a schematic diagram of an edit image in a first operation mode.
Figure 4:
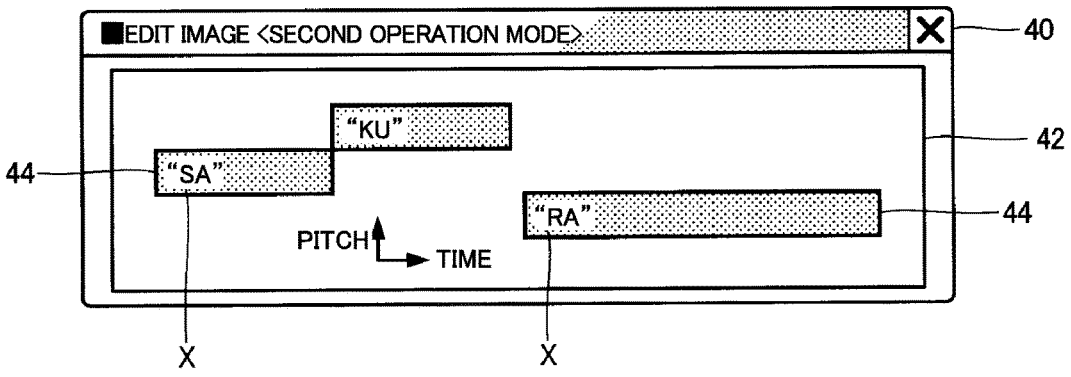
FIG. 4 is a schematic diagram of an edit image in a second operation mode.

The display control unit 22 causes a display mode (visually perceptible properties such as coloring and pattern) of the edit image 40 to differ between the first operation mode and the second operation mode. FIG. 3 referred to above is a schematic diagram of the edit image 40 displayed when the first operation mode is chosen, and FIG. 4 is a schematic diagram of the edit image 40 displayed when the second operation mode is chosen. As understood from FIG. 3 and FIG. 4, the display control unit 22 according to the first embodiment causes the coloring and the pattern of each of the note pictograms 44 arranged in the musical notation area 42 of the edit image 40 to differ between the first operation mode and the second operation mode. This produces an advantage that the user may visually and intuitively grasp the current operation mode (first operation mode or second operation mode) of the voice synthesis device 100.

Figure 5:
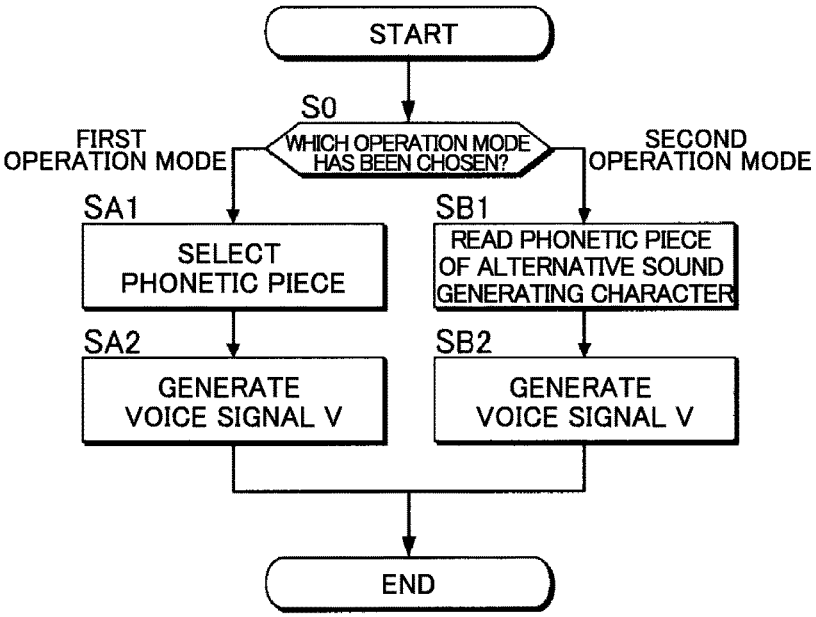
FIG. 5 is a flowchart of an operation of a voice synthesis unit.

FIG. 5 is a flowchart of an operation for generating the voice signal V by the voice synthesis unit 26. The voice synthesis unit 26 starts the processing of FIG. 5 when instructed to start a voice synthesis through an operation with respect to the input device 16. After starting the processing of FIG. 5, the voice synthesis unit 26 determines which of the first operation mode and the second operation mode has been chosen (S0).

When the first operation mode is chosen, the voice synthesis unit 26 executes the first synthesis process (SA1 and SA2). Specifically, the voice synthesis unit 26 sequentially selects, from the phonetic piece group L, the phonetic pieces corresponding to the sound generating characters X specified for the respective notes by the voice synthesis information S stored in the storage device 12 (SA1), and generates the voice signal V by concatenating the phonetic pieces to each other after adjusting each of the phonetic pieces to the pitch P and the sound generation period T that are specified by the voice synthesis information S (SA2). In the first synthesis process, when the sound generating character X is formed of a consonant and a vowel, the voice synthesis unit 26 adjusts locations of phonemes that form each of the phonetic pieces on the time axis so that the sound generation of the consonant is started prior to a start point of the sound generation period T and the sound generation of the vowel is started at the start point of the sound generation period T.

On the other hand, when the second operation mode is selected, the voice synthesis unit 26 executes the second synthesis process (SB1 and SB2). Specifically, the voice synthesis unit 26 reads the phonetic piece of the alternative sound generating character from the phonetic piece group L stored in the auxiliary storage device included in the storage device 12 onto the main storage device (SB1), and generates the voice signal V by concatenating the phonetic pieces to each other after adjusting the phonetic pieces to the pitch P and the sound generation period T of each note specified by the voice synthesis information S (SB2). In the second synthesis process, the voice synthesis unit 26 adjusts the locations of the phonemes that form each of the phonetic pieces on the time axis so that the sound generation of each note is started at the start point of the sound generation period T. As exemplified above, in the first operation mode (first synthesis process), various phonetic pieces corresponding to the sound generating characters X for the respective notes are sequentially selected from the phonetic piece group L, while in the second operation mode (second synthesis process), the phonetic pieces corresponding to the alternative sound generating characters are fixedly held by the main storage device, and repeatedly used to synthesize the singing voice over a plurality of notes in the same manner. Therefore, in the second synthesis process, a processing load (in addition, processing delay) is reduced to a lower level than in the first synthesis process.

Figure 6:
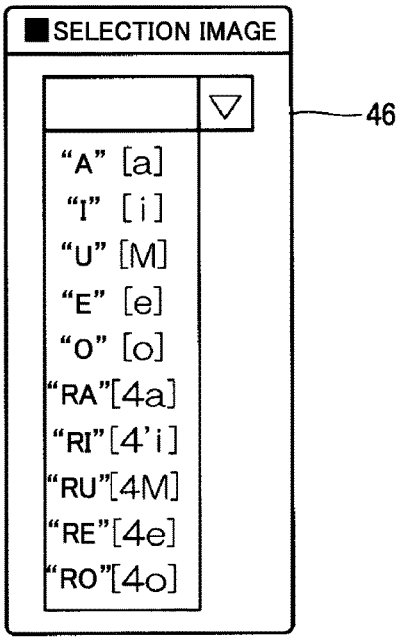
FIG. 6 is a schematic diagram of a selection image.

The alternative sound generating character used in the second operation mode is a sound generating character selected in advance from a plurality of candidates by the user through the operation with respect to the input device 16. FIG. 6 is a schematic diagram of a selection image 46 that allows the user to select the alternative sound generating character. The display control unit 22 causes the display device 14 to display the selection image 46 illustrated in FIG. 6 with a predetermined operation (instruction to select the alternative sound generating character) with respect to the input device 16 as a trigger.

As exemplified in FIG. 6, a plurality of sound generating characters (hereinafter referred to as "candidate characters") to be candidates for the user's selection are arrayed in the selection image 46 according to the first embodiment. Specifically, the sound generating character having a relatively small delay amount (hereinafter referred to as "vowel start delay amount") between a start of the sound generation of the sound generating character and a start of the sound generation of the vowel of the sound generating character is presented to the user as the candidate character. The vowel start delay amount can be referred to also as a duration of the consonant positioned immediately before the vowel. For example, FIG. 6 is an illustration of an exemplary case where the vowels themselves ("a" [a], "i" [i], "u" [M], "e" [e], and "o" [o], each of which has a vowel start delay amount of zero, and liquids ("ra" [4a], "ri" [4'i], "ru" [4M], "re" [4e], and "ro" [4o]), each of which is a consonant having a relatively smaller vowel start delay amount than consonants of other types, are set as the candidate characters (phoneme representations conforming to X-SAMPA are bracketed by "[" and "]"). The user may select a desired alternative sound generating character from a plurality of candidate characters within the selection image 46 by appropriately operating the input device 16.

As described above, in the second operation mode, the sound generating character X for each note specified by the voice synthesis information S is replaced with the alternative sound generating character having a relatively short vowel start delay amount. In other words, the second operation mode is an operation mode (low delay mode) for reducing the delay between the start of the sound generation of the consonant and the start of the sound generation of the vowel.

As exemplified above, in the first embodiment, the voice signal V of an utterance sound of each sound generating character X specified by the voice synthesis information S is generated in the first operation mode (first synthesis process), and the voice signal V of an utterance sound obtained by replacing each sound generating character X specified by the voice synthesis information S with the alternative sound generating character is generated in the second operation mode (second synthesis process). Therefore, according to the first embodiment, the first operation mode allows the voice signal V of the utterance sound of an arbitrary sound generating character X to be generated, while the second operation mode allows the voice signal V obtained by reducing the delay between the start point of the sound generation period T and the start of the sound generation of the vowel to be generated.

Second Embodiment

A second embodiment of the present invention is exemplified below. In each of embodiments exemplified below, components having the same actions and functions as those of the first embodiment are also denoted by the reference symbols used for the description of the first embodiment, and detailed descriptions of the respective components are omitted appropriately.

Figures 7, 8:
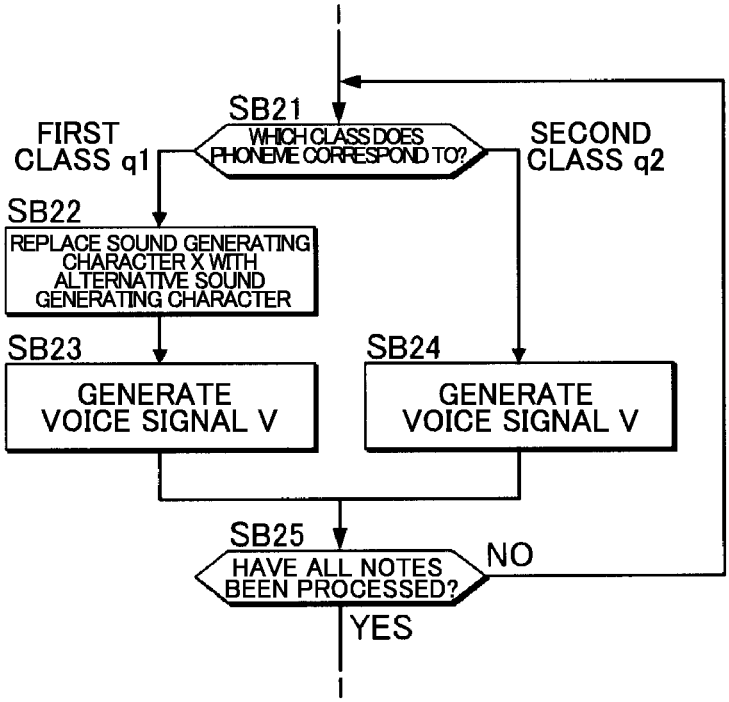
FIG. 7 is a schematic diagram of phoneme classification information.
FIG. 8 is a flowchart of a second synthesis process according to a second embodiment of the present invention.

The storage device 12 according to the second embodiment stores phoneme classification information Q illustrated in FIG. 7 in addition to the same information (phonetic piece group L and voice synthesis information S) as that of the first embodiment. As exemplified in FIG. 7, the phoneme classification information Q specifies types of respective phonemes that can be included in the singing voice. Specifically, in the phoneme classification information Q according to the second embodiment, the respective phonemes that form the phonetic pieces employed for the voice synthesis processing are classified into a first class q1 and a second class q2. The first class q1 is a class of a phoneme having a relatively large vowel start delay amount (for example, phoneme having a vowel start delay amount exceeding a predetermined threshold value), and the second class q2 is a class of a phoneme having a relatively smaller vowel start delay amount than the phoneme of the first class q1 (for example, phoneme having a vowel start delay amount falling below a predetermined threshold value). For example, consonants including semivowels (/w/, /y/), nasals (/m/, /n/), an affricate (/ts/), fricatives (/s/, /f/), and contracted sounds (/kja/, /kju/, /kjo/) are classified into the first class q1, and phonemes including the vowels (/a/, /i/, /u/), liquids (/r/, /l/), and plosives (/t/, /k/, /p/) are classified into the second class q2. Note that, for example, a diphthong formed of a series of two vowels is preferred to be handled so as to be classified into the first class q1 when the second vowel is stressed and classified into the second class q2 when the first vowel is stressed.

FIG. 8 is a flowchart of the second synthesis process executed by the voice synthesis unit 26 when the second operation mode is chosen according to the second embodiment. In the second embodiment, the processing of Step SB2 illustrated in FIG. 5 referred to above is replaced with the processing of Steps SB21 to SB25 illustrated in FIG. 8. Specifically, the voice synthesis unit 26 refers to the phoneme classification information Q stored in the storage device 12, to thereby determine which of the first class q1 and the second class q2 the sound generating character X (first phoneme when the sound generating character X is formed of a plurality of phonemes) for one note specified by the voice synthesis information S corresponds to (SB21).

When the sound generating character X corresponds to the first class q1, the voice synthesis unit 26 replaces the sound generating character X with the alternative sound generating character (SB22), and generates the voice signal V by concatenating the phonetic pieces of the alternative sound generating characters to each other after adjusting the phonetic pieces to the pitch P and the sound generation period T of each note (SB23). On the other hand, when the sound generating character X corresponds to the second class q2, replacement (change to the alternative sound generating character) of the sound generating character X is not executed. In other words, the voice synthesis unit 26 selects the phonetic piece corresponding to the sound generating character X from the phonetic piece group L, and generates the voice signal V by concatenating the phonetic pieces to each other after adjusting the phonetic pieces to the pitch P and the sound generation period T (SB24). The above-mentioned processing is repeated for all the notes specified by the voice synthesis information S in order (SB25: NO).

As understood from the above description, the voice synthesis unit 26 according to the second embodiment replaces the sound generating character X of the first class q1 having a large vowel start delay amount among the plurality of sound generating characters X specified by the voice synthesis information S with the alternative sound generating character, while inhibiting execution of the replacement of the sound generating character X of the second class q2 having a small vowel start delay amount with the alternative sound generating character. Note that, details of the first synthesis process executed in the first operation mode and an operation for causing the display mode of each note pictogram 44 within the edit image 40 to differ between the first operation mode and the second operation mode are the same as those of the first embodiment.

Also in the second embodiment, the same effects are realized as in the first embodiment. Further, in the second operation mode according to the second embodiment, the sound generating character X of the first class q1 among the plurality of sound generating characters X specified by the voice synthesis information S is replaced with the alternative sound generating character, while the sound generating character X of the second class q2 is maintained as specified by the voice synthesis information S. This produces an advantage that the voice signal V may be generated so that the delay until the start of the sound generation of the vowel is effectively reduced for the phoneme of the first class q1 while maintaining a moderate number of sound generating characters X of the voice synthesis information S.

Third Embodiment

In a third embodiment of the present invention, for example, an electronic musical instrument such as a MIDI instrument is used as the input device 16. In the second operation mode, the user may sequentially specify a desired pitch P and a desired sound generation period T for each note by appropriately operating the input device 16. For example, in a case where the input device 16 of a keyboard instrument type is used, the pitch P and the sound generation period T are sequentially specified each time the user depresses a key. The information editing unit 24 generates the unit information U for each instruction to specify a note issued by the user, and adds the unit information U to the voice synthesis information S stored in the storage device 12. The unit information U on each note specifies the pitch P and the sound generation period T as instructed by the user, and specifies an initial-state sound generating character (hereinafter referred to as "initial sound generating character") such as "a" as the sound generating character X. A time series of pieces of unit information U generated for each instruction issued by the user are stored in the storage device 12 as the voice synthesis information S.

On the other hand, the display control unit 22 adds the note pictogram 44 for representing the note of the unit information U, which is generated by the information editing unit 24 in response to the instruction issued from the user in the second operation mode, sequentially to the edit image 40 for each instruction to specify the note issued by the user. When temporary inputting of the notes is completed in the second operation mode, the user changes the operation mode of the voice synthesis device 100 to the first operation mode. In the first operation mode, the information editing unit 24 edits the voice synthesis information S generated in the second operation mode in response to the instruction issued from the user to the input device 16 in the same manner as in the first embodiment. The operation for causing the display mode of each note pictogram 44 within the edit image 40 to differ between the first operation mode and the second operation mode is the same as that of the first embodiment.

The voice synthesis unit 26 according to the third embodiment generates the voice signal V in the second operation mode by processing the unit information U in real time in parallel with the instruction to specify the note issued by the user (real-time voice synthesis). In other words, the voice synthesis unit 26 generates the voice signal V of the utterance sound obtained by replacing the sound generating character X (initial sound generating character) of the unit information U sequentially generated by the information editing unit 24 with the alternative sound generating character. Specifically, the voice synthesis unit 26 generates the voice signal V by adjusting the phonetic pieces of the alternative sound generating characters read onto the main storage device of the storage device 12 to the pitches P and the sound generation periods T specified by the user and concatenating the phonetic pieces before and after the adjustment between successive notes. Note that, the details of the first synthesis process executed in the first operation mode are the same as those of the first embodiment.

Also in the third embodiment, the same effects are realized as in the first embodiment. Note that, in a configuration for generating the voice signal V in real time in parallel with the instruction to specify the note issued by the user, there is a problem in that the delay between the time of the instruction to specify the note and the time at which the sound generation of the vowel for the note is started is likely to be perceived by a listener. Therefore, one or more embodiments of the present invention capable of reducing the delay until the start of the sound generation of the vowel is remarkably preferred for a configuration for generating the voice signal V in real time in parallel with the instruction to specify the note issued by the user as in the third embodiment.

Fourth Embodiment

Figure 9:
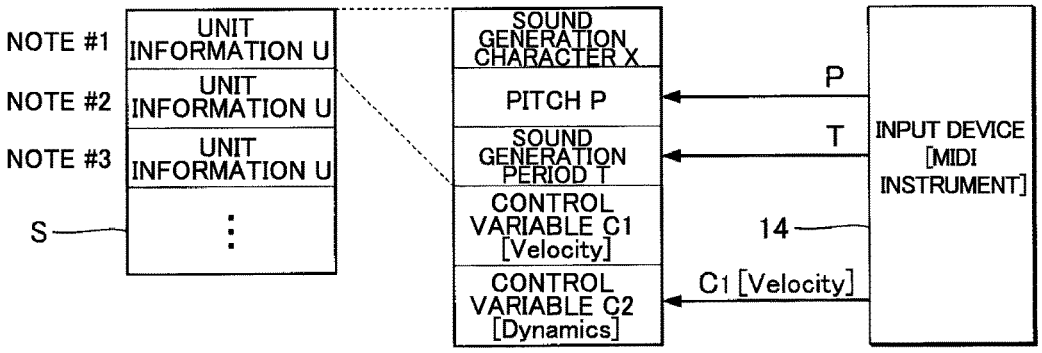
FIG. 9 is a schematic diagram of voice synthesis information according to a fourth embodiment of the present invention.

FIG. 9 is a schematic diagram of the voice synthesis information S according to a fourth embodiment of the present invention. As exemplified in FIG. 9, each piece of unit information U within the voice synthesis information S according to the fourth embodiment includes a control variable C1 and a control variable C2 in addition to the same information (sound generating character X, pitch P, and sound generation period T) as that of the first embodiment. The control variable C1 and the control variable C2 are parameters for controlling musical expressions (acoustic characteristics of the voice signal V) of the singing voice for each note. Specifically, as exemplified in FIG. 9, the control variable C1 (first control variable) is, for example, a velocity conforming to the MIDI standard, and the control variable C2 (second control variable) is dynamics (volume).

In the first synthesis process in the first operation mode, the voice synthesis unit 26 controls characteristics of the voice signal V based on the control variable C1 and the control variable C2. Specifically, the voice synthesis unit 26 controls the duration of the consonant at a head of the sound generating character X of each note (rising speed of the voice immediately after the sound generation) based on the control variable C1. For example, as a numerical value of the control variable C1 (velocity) becomes larger, the sound generating character X is set to have a shorter duration of the consonant. Further, the voice synthesis unit 26 controls the volume of each note of the voice signal V based on the control variable C2. For example, as a numerical value of the control variable C2 (dynamics) becomes larger, the volume is set to have a larger numerical value.

On the other hand, in the second operation mode, in the same manner as in the third embodiment, the voice signal V is generated in real time in parallel with the instruction to specify the note issued by the user. In the fourth embodiment, the control variable C1 is supplied from the input device 16 in addition to the pitch P and the sound generation period T that are instructed by the user through the operation with respect to the input device 16. The control variable C1 corresponds to the velocity conforming to the MIDI standard, and is set to the numerical value corresponding to the operation intensity (intensity or speed of the depressing of the key) applied to the input device 16.

The user tends to adjust the operation intensity applied to the input device 16 with an intention of changing the volume of the synthesized voice. In consideration of the above-mentioned tendency, the voice synthesis unit 26 according to the fourth embodiment controls the volume of each note of the voice signal V based on the control variable C1 (namely, operation intensity applied by the user) supplied from the input device 16 in the second synthesis process in the second operation mode.

As exemplified above, in the first operation mode, the control variable C1 is employed for the control of the duration of the consonant with the control variable C2 being employed for the control of the volume, while in the second operation mode, the control variable C1 is employed for the control of the volume. In other words, the meaning of the control variable C1 differs between the first operation mode (control of the duration of the consonant) and the second operation mode (control of the volume), and the control variable C2 in the first operation mode and the control variable C1 in the second operation mode have the same meaning (control of the volume).

In consideration of the above-mentioned circumstances, the information editing unit 24 according to the fourth embodiment sets the numerical value of the control variable C1 specified in the second operation mode as the numerical value of the control variable C2 specified by the unit information U within the voice synthesis information S. Specifically, as exemplified in FIG. 9, each time the pitch P, the sound generation period T, and the control variable C1 are supplied from the input device 16 for each note, the information editing unit 24 adds the unit information U to the voice synthesis information S, the unit information U including: the pitch P and the sound generation period T that are supplied from the input device 16, the sound generating character X set to the initial sound generating character, the control variable C2 set to the numerical value equivalent to that of the control variable C1 supplied from the input device 16, and the control variable C1 set to a predetermined initial value. As understood from the above description, in the first operation mode, the voice signal V having the volume corresponding to the operation conducted with respect to the input device 16 (operation intensity applied thereto) in the second operation mode is generated. On the other hand, the control variable C1 in the second operation mode is not reflected in the control variable C1 in the first operation mode (duration of the consonant).

Also in the fourth embodiment, the same effects are realized as in the first embodiment. Further, in the fourth embodiment, the control variable C2 employed for the control of the volume in the first operation mode is set to the numerical value equivalent to that of the control variable C1 employed for the control of the volume similarly in the second operation mode, which produces an advantage that the voice signal V in which the user's intention (depressing intensity of the key for each note) is reflected in the second operation mode may be generated also in the first operation mode even with the configuration in which the meaning of the control variable C1 differs between the first operation mode (control of the duration of the consonant) and the second operation mode (control of the volume).

Modification Examples

Each of the embodiments exemplified above may be changed variously. Embodiments of specific changes are exemplified below. It is also possible to appropriately combine at least two embodiments selected arbitrarily from the following examples.

(1) In each of the above-mentioned embodiments, the candidate character selected by the user among the plurality of candidate characters provided in advance is used as the alternative sound generating character, but a method of setting the alternative sound generating character is not limited to the above-mentioned example. For example, the alternative sound generating character may also be provided in advance for each type of phoneme of the sound generating character X so that, in the second operation mode, the sound generating character X for each note is replaced with the alternative sound generating character corresponding to the type of phoneme of the sound generating character X.

Further, in each of the above-mentioned embodiments, one sound generating character X is entirely replaced with the alternative sound generating character, but a partial phoneme (typically, vowel) of one sound generating character X may be maintained. For example, the sound generating character X in which a vowel succeeds a consonant may also be replaced with the alternative sound generating character formed of the phoneme of the vowel obtained by omitting the consonant in the second operation mode. Further, there may also be employed a configuration for replacing the sound generating character X in which the vowel succeeds the consonant with the alternative sound generating character, which is obtained by changing only the consonant to another phoneme (for example, consonant having a small vowel start delay amount) while maintaining the vowel, in the second operation mode.

(2) In each of the above-mentioned embodiments, the data on the voice synthesis information S is maintained for the sound generating character X added to each note pictogram 44 on the display device 14 in the second operation mode in which each sound generating character X is replaced with the alternative sound generating character in the second synthesis process (FIG. 4), but the sound generating character X for the note pictogram 44 arranged in the edit image 40 may be replaced with the alternative sound generating character also in the second operation mode. When an operation mode is changed from the second operation mode to the first operation mode, the alternative sound generating character for each note pictogram 44 is changed to the sound generating character X specified for each note by the voice synthesis information S.

(3) In the configuration for generating the voice signal V in real time in parallel with the instruction to specify the note issued by the user in the second operation mode as in the third embodiment and the fourth embodiment, there is a particular demand to reduce the delay amount between the instruction to specify the note issued by the user (operation with respect to the input device 16) and the start of the actual reproduction of the synthesized voice for the note. In consideration of the above-mentioned circumstances, it is also preferred to employ a configuration for changing (typically, simplifying) or omitting a part of processing executed in the first synthesis process in the second synthesis process in the second operation mode. For example, processing for generating the phonetic piece for a target pitch P by mixing (morphing) a plurality of phonetic pieces corresponding to mutually different pitches may be executed in the first synthesis process, and processing for adjusting one phonetic piece to the pitch P may be executed (while omitting the mixing of the plurality of phonetic pieces) in the second synthesis process. The configuration for reducing the processing amount of the second synthesis process to a lower level than that of the first synthesis process as described above allows a reduction in the delay amount between the instruction to specify the note issued by the user and a start of the actual reproduction of the synthesized voice for the note.

(4) In the first operation mode, the sound generation of the consonant is started at a time point prior to the start point of the sound generation period T, and hence the voice synthesis needs to be started at a time point earlier than the start point of a sound generation period of the first note in the time series of a plurality of notes to be synthesized by a specific time length (hereinafter referred to as "preliminary time"). However, the duration may differ depending on the type of consonant, and hence it is preferred to employ a configuration in which the consonant having the longest duration is retrieved from among the consonants of the sound generating characters X for a plurality of notes specified by the voice synthesis information S to set the preliminary time to a time length longer than the duration of the retrieved consonant by a predetermined length (namely, variable time length corresponding to the longest duration of the consonant among targets to be reproduced). The above-mentioned configuration produces an advantage that a time point of a start of the voice synthesis does not need to be advanced to an earlier time point than the start point of the first note by a needless length. Note that, the preliminary time may also be variably controlled depending on a tempo of the voice synthesis.

(5) In the third embodiment and the fourth embodiment, the sound generating character X of the unit information U generated by the information editing unit 24 for each instruction to specify the note issued by the user is set to a predetermined initial sound generating character (for example, "a"). However, for example, the time series of the plurality of sound generating characters X (namely, lyrics of a song) may also be generated in advance in response to the instruction issued from the user to the input device 16, to be assigned to the sound generating characters X of the respective pieces of unit information U one by one from the head for each instruction to specify the note issued by the user (so-called lyrics flow).

(6) In the fourth embodiment, the unit information U including the control variable C2 set to the numerical value equivalent to that of the control variable C1 is added to the voice synthesis information S each time the user specifies the note through the operation with respect to the input device 16 in the second operation mode, but a timing at which the control variable C1 corresponding to the operation with respect to the input device 16 in the second operation mode is reflected in the control variable C2 to be used in the first operation mode is not limited to the timing exemplified above (for each instruction to specify the note). For example, the time series of the control variables C1 sequentially specified by the user in the second operation mode may also be held in the storage device 12 to collectively set the control variables C2 of the respective pieces of unit information U within the voice synthesis information S to the numerical values equivalent to those of the control variables C1 in the second operation mode when a change from the second operation mode to the first operation mode is instructed by the user. Further, when the change from the second operation mode to the first operation mode is instructed by the user, the user may be caused to select whether or not to duplicate the control variable C1 in the second operation mode as the control variable C2 of the voice synthesis information S (for example, the display device 14 may be caused to display a message such as "Are you sure to replace Velocity with Dynamics?"), and when the user permits the duplication, the control variable C2 of each piece of unit information U may be set to the numerical value of the control variable C1 in the second operation mode.

(7) In each of the above-mentioned embodiments, the sound generating character X in Japanese is exemplified, but a language for the sound generating character X (language for the voice to be synthesized) is arbitrarily selected. For example, the present invention may be applied to generation of a voice in an arbitrary language such as English, Spanish, Chinese, or Korean.

(8) In each of the above-mentioned embodiments, a concatenative voice synthesis for concatenating the plurality of phonetic pieces to each other is exemplified, but a method for the voice synthesis (first synthesis process and second synthesis process) executed by the voice synthesis unit 26 is not limited to the above-mentioned examples. For example, the voice signal V may also be generated by a voice synthesis of a probabilistic model type for executing filter processing corresponding to the sound generating character X for a transition (pitch curve) of a pitch estimated by using a probabilistic model represented by a hidden Markov model (HMM).

(9) The voice synthesis device 100 may also be realized by a server device for communicating to/from a terminal device through a communication network such as a mobile communication network or the Internet. Specifically, the voice synthesis device 100 executes the processing exemplified in each of the above-mentioned embodiments for the voice synthesis information S received from the terminal device through the communication network, to thereby generate the voice signal V and transmit the voice signal V to the terminal device.

A voice synthesis device according to a preferred mode of the present invention includes a voice synthesis unit configured to selectively execute the first synthesis process for generating a voice signal of the utterance sound of the sound generating character by using voice synthesis information for specifying the sound generating character and the second synthesis process for generating the voice signal of the utterance sound obtained by replacing at least a part of the sound generating characters specified by the voice synthesis information with the alternative sound generating character different from the sound generating character. In the above-mentioned configuration, the voice signal of the utterance sound of each sound generating character specified by the voice synthesis information is generated in the first synthesis process, while the voice signal of the utterance sound obtained by replacing at least a part of the respective sound generating characters specified by the voice synthesis information with the alternative sound generating character is generated in the second synthesis process. Therefore, the voice signal of the utterance sound of an arbitrary sound generating character can be generated in the first synthesis process, while the voice signal obtained by reducing the delay between the start of the sound generation and the start of the sound generation of the vowel can be generated in the second synthesis process.

In a preferred mode of the present invention, the voice synthesis unit is further configured to replace, in the second synthesis process, the sound generating character of a first class, which exhibits a large delay amount between the start of the sound generation of the consonant and the start of the sound generation of the vowel immediately after the consonant, among the plurality of sound generating characters specified by the voice synthesis information with the alternative sound generating character, and inhibit the sound generating character of a second class different from the first class from being replaced. In the second synthesis process according to the above-mentioned mode, the sound generating character of the first class, which exhibits a large delay amount between the start of the sound generation of the consonant and the start of the sound generation of the vowel immediately after the consonant, is replaced with the alternative sound generating character, and the replacement of the sound generating character of the second class different from the first class with the alternative sound generating character is inhibited from being executed. This produces an advantage that the voice signal can be generated so that the delay until the start of the sound generation of the vowel is effectively reduced for the phoneme of the first class while maintaining a moderate number of sound generating characters specified by the voice synthesis information. Note that, a specific example of the above-mentioned mode is described in, for example, the second embodiment.

The voice synthesis device according to a preferred mode of the present invention includes an information editing unit configured to sequentially generate unit information for specifying a predetermined sound generating character in response to an instruction issued from the user to an input device and add the unit information to the voice synthesis information, and in the voice synthesis device, the voice synthesis unit is further configured to generate the voice signal of the utterance sound of the alternative sound generating character different from the predetermined sound generating character specified by the unit information in the second synthesis process in real time in parallel with the instruction issued to the input device. In the configuration for generating the voice signal in real time in parallel with the instruction issued by the user, there is a problem in that the delay until the start of the sound generation of the vowel for the note is likely to be perceived by the user, and hence one or more embodiments of the present invention capable of reducing the delay until the start of the sound generation of the vowel is remarkably preferred. Note that, a specific example of the above-mentioned mode is described in, for example, the third embodiment or the fourth embodiment.

In a preferred mode of the present invention, the voice synthesis unit is further configured to: control the duration of the consonant of the voice signal based on the first control variable specified by the unit information within the voice synthesis information and control the volume of the voice signal based on the second control variable specified by the unit information in the first synthesis process; and control the volume of the voice signal based on the first control variable corresponding to the operation with respect to the input device in the second synthesis process, and the information editing unit is further configured to set the numerical value of the first control variable specified in the second synthesis process as the numerical value of the second control variable specified by the unit information. In the above-mentioned mode, the second control variable employed for the control of the volume of the voice signal in the first synthesis process is set to the numerical value equivalent to that of the first control variable employed for the control of the volume similarly in the second operation mode, which produces an advantage that the voice signal in which the user's intention (operation with respect to the input device) is reflected in the second synthesis process can be generated also in the first synthesis process even with the configuration in which the meaning (control target) of the first control variable differs between the first synthesis process and the second synthesis process. Note that, a specific example of the above-mentioned mode is described in, for example, the fourth embodiment.

In a preferred mode of the present invention, the voice synthesis information specifies the sound generating character, the pitch, and the sound generation period for each note, and the voice synthesis device according to the preferred mode further includes a display control unit configured to: cause a display device to display an edit image, in which a note pictogram for representing each note specified by the voice synthesis information is arranged in a musical notation area defined by setting the time axis and the pitch axis; and cause the display mode of the note pictogram to differ between an execution time of the first synthesis process and an execution time of the second synthesis process. In the above-mentioned mode, the display mode of the note pictogram differs between the execution time of the first synthesis process and the execution time of the second synthesis process, which produces an advantage that the user can visually and intuitively grasp the situation as to which of the first synthesis process and the second synthesis process is to be executed. Note that, the display mode means the properties of the image by which the user may visually discriminate the image, and typical examples of the display mode include brightness (gradation), chroma, and hue.

In a preferred mode of the present invention, the alternative sound generating character is the sound generating character selected by the user from a plurality of candidates. In the above-mentioned mode, the sound generating character that matches the user's preferences and intention is used as the alternative sound generating character in the second synthesis process, which produces an advantage that the voice signal exhibiting a reduced sense of incongruity on acoustic feeling of individual users can be generated.

The voice synthesis device according to each of the above-mentioned embodiments is implemented by hardware (electronic circuit) such as a digital signal processor (DSP), and is also implemented in cooperation between a general-purpose processor unit such as a central processing unit (CPU) and a program. The program according to the present invention may be installed on a computer by being provided in a form of being stored in a computer-readable recording medium. The recording medium is, for example, a non-transitory recording medium, whose preferred examples include an optical recording medium (optical disc) such as a CD-ROM, and may contain a known recording medium of an arbitrary format, such as a semiconductor recording medium or a magnetic recording medium. For example, the program according to the present invention may be installed on the computer by being provided in a form of being distributed through a communication network. Further, the present invention is also defined as an operation method (voice synthesis method) for the voice synthesis device according to each of the above-mentioned embodiments.

Note that, a voice synthesis information acquisition unit, a replacement unit, and a voice synthesis unit as defined in the appended claims are included in, for example, the voice synthesis unit 26 described above.

While there have been described what are at present considered to be certain embodiments of the invention, it will be understood that various modifications may be made thereto, and it is intended that the appended claims coverall such modifications as fall within the true spirit and scope of the invention.

What is claimed is:

1. A voice synthesis device comprising:

a processor configured to implement instructions stored in a memory and execute:

a voice synthesis information acquisition task that acquires voice synthesis information for specifying a sound generating character, a pitch, and a sound generation period for each note, wherein the sound generating character is a symbol for expressing a mora formed of one of a single vowel and a combination of a consonant and a vowel;

a display control task that:

causes a display device to display an edit image, in which a note pictogram for representing each note specified by the voice synthesis information is arranged in a musical notation area defined by setting a time axis and a pitch axis;

causes a display mode of the note pictogram to differ between an execution time of one selective operation mode and an execution time of another selective operation mode; and displays, on the display device, a plurality of candidates of alternative sound generating characters selectable by a user viewing the display device;

a replacement task that, in the one selective operation mode, replaces at least a part of sound generating characters specified by the voice synthesis information with an alternative sound generating character, which is different from the part of sound generating characters, selected by the user from the plurality of candidates displayed on the display device by the display control task, wherein the alternative sound generating character is formed of the vowel obtained by omitting the consonant of the sound generating character;

a voice synthesis task that, in the one selective operation mode:

replaces the sound generating character of a first class, which exhibits a large delay amount between a start of sound generation of a consonant and a start of sound generation of a vowel immediately after the consonant, among a plurality of sound generating characters specified by the voice synthesis information with the alternative sound generating character;

inhibits the sound generating character of a second class different from the first class from being replaced; and generates a voice signal of an utterance sound with the synthesis information that has been altered by the replacement task.

2. The voice synthesis device according to claim 1, wherein:

the processor is further configured to execute an information editing task that sequentially generates first information for specifying a predetermined sound generating character in response to an instruction issued from the user to an input device and add the first information to the voice synthesis information, the voice synthesis task, in the one selective operation mode, also generates the voice signal of the utterance sound with the synthesis information that has been altered by the replacement task and further specified by the first information in real time in parallel with the instruction issued to the input device.

3. The voice synthesis device according to claim 1, wherein the voice synthesis task, in the another selective operation mode, generates the voice signal of the utterance sound of the sound generating character using the voice synthesis information for specifying the sound generating character.

4. The voice synthesis device according to claim 2, wherein the voice synthesis task, in the another selective operation mode, generates the voice signal of the utterance sound of the sound generating character using the voice synthesis information for specifying the sound generating character.

5. The voice synthesis device according to claim 4, wherein:

the voice synthesis task further:

controls a duration of a consonant of the voice signal based on a first control variable specified by the first information;

controls a volume of the voice signal based on a second control variable specified by the first information; and control, in the one selective operation mode, the volume of the voice signal based on the first control variable corresponding to an operation with respect to the input device; and the information editing task further sets, in the one selective operation mode, a numerical value of the first control variable as a numerical value of the second control variable specified by the first information.

6. The voice synthesis device according to claim 1, wherein the alternative sound generating character is defined in advance.

7. The voice synthesis device according to claim 1, wherein the alternative sound generating character is formed by changing the consonant of the sound generating character to another consonant.

8. The voice synthesis device according to claim 1, wherein the alternative sound generating character is repeatedly used to synthesize a singing voice over a plurality of notes.

9. A voice synthesis method comprising the steps of:

acquiring voice synthesis information for specifying a sound generating character, a pitch, and a sound generation period for each note, wherein the sound generating character is a symbol for expressing a mora formed of one of a single vowel and a combination of a consonant and a vowel;

controlling a display device to:

cause the display device to display an edit image, in which a note pictogram for representing each note specified by the voice synthesis information is arranged in a musical notation area defined by setting a time axis and a pitch axis;

cause a display mode of the note pictogram to differ between an execution time of one selective operation mode and an execution time of another selective operation mode; and display, on the display device, a plurality of candidates of alternative sound generating characters selectable by a user viewing the display device;

replacing, in the one selective mode, at least a part of sound generating characters specified by the voice synthesis information with an alternative sound generating character, which is different from the part of sound generating characters, selected by the user from the plurality of candidates displayed on the display device in the controlling step, wherein the alternative sound generating character is formed of the vowel obtained by omitting the consonant of the sound generating character;

voice synthesizing, replacing, in the one selective operation mode, by:

replacing the sound generating character of a first class, which exhibits a large delay amount between a start of sound generation of a consonant and a start of sound generation of a vowel immediately after the consonant, among a plurality of sound generating characters specified by the voice synthesis information with the alternative sound generating character; and inhibiting the sound generating character of a second class different from the first class from being replaced; and generating a voice signal of an utterance sound obtained with the synthesis information that has been altered in the replacing step replacing at least a part of sound generating characters specified by the voice synthesis information with an alternative sound generating character.

10. A non-transitory recording medium storing a voice synthesis program executable by a computer to execute a voice synthesis method comprising the steps of:

acquiring voice synthesis information for specifying a sound generating character, a pitch, and a sound generation period for each note, wherein the sound generating character is a symbol for expressing a mora formed of one of a single vowel and a combination of a consonant and a vowel;

controlling a display device to:

cause the display device to display an edit image, in which a note pictogram for representing each note specified by the voice synthesis information is arranged in a musical notation area defined by setting a time axis and a pitch axis;

cause a display mode of the note pictogram to differ between an execution time of one selective operation mode and an execution time of another selective operation mode; and display, on the display device, a plurality of candidates of alternative sound generating characters selectable by a user viewing the display device;

replacing, in the one selective mode, at least a part of sound generating characters specified by the voice synthesis information with an alternative sound generating character, which is different from the part of sound generating characters, selected by the user from the plurality of candidates displayed on the display device in the controlling step, wherein the alternative sound generating character is formed of the vowel obtained by omitting the consonant of the sound generating character;

voice synthesizing, in the one selective operation mode, by:

replacing the sound generating character of a first class, which exhibits a large delay amount between a start of sound generation of a consonant and a start of sound generation of a vowel immediately after the consonant, among a plurality of sound generating characters specified by the voice synthesis information with the alternative sound generating character;

inhibiting the sound generating character of a second class different from the first class from being replaced; and generating a voice signal of an utterance sound obtained with the synthesis information that has been altered in the replacing step of replacing at least a part of sound generating characters specified by the voice synthesis information with an alternative sound generating character.

* * * * *